US011453219B2

(12) United States Patent
Lavigne

(10) Patent No.: US 11,453,219 B2
(45) Date of Patent: Sep. 27, 2022

(54) PRINT SUBSTANCE CONTAINER VIBRATION

(71) Applicant: HEWLETT-PACKARD DEVELOPMENT COMPANY, L.P., Spring, TX (US)

(72) Inventor: Mathew Lavigne, Boise, ID (US)

(73) Assignee: HEWLETT-PACKARD DEVELOPMENT COMPANY, L.P., Spring, TX (US)

( * ) Notice: Subject to any disclaimer, the term of this patent is extended or adjusted under 35 U.S.C. 154(b) by 197 days.

(21) Appl. No.: 16/763,820

(22) PCT Filed: Apr. 5, 2018

(86) PCT No.: PCT/US2018/026218

§ 371 (c)(1),
(2) Date: May 13, 2020

(87) PCT Pub. No.: WO2019/194807

PCT Pub. Date: Oct. 10, 2019

(65) Prior Publication Data

US 2020/0369036 A1 Nov. 26, 2020

(51) Int. Cl.

| | |
|---|---|
| ***B01F 31/20*** | (2022.01) |
| ***B06B 1/16*** | (2006.01) |
| ***B41J 2/175*** | (2006.01) |
| *B01F 101/35* | (2022.01) |

(52) U.S. Cl.

CPC ..... *B41J 2/17513* (2013.01); *B01F 31/265* (2022.01); *B06B 1/16* (2013.01); *B01F 2101/35* (2022.01)

(58) Field of Classification Search

CPC .... B41J 2/175; B41J 2/17513; B41J 2/17566; B01F 21/10; B01F 31/265; B01F 2101/35; B06B 1/16

See application file for complete search history.

(56) References Cited

U.S. PATENT DOCUMENTS

| | | | | |
|---|---|---|---|---|
| 4,085,955 | A * | 4/1978 | Salle | B43K 13/02 134/117 |
| 6,335,055 | B1 | 1/2002 | Miyahara | |
| 7,621,627 | B2 | 11/2009 | Ohashi | |
| 8,864,294 | B1 | 10/2014 | Leighton | |
| 9,802,415 | B2 | 10/2017 | Driessen-Olde Scheper | |
| 2007/0252679 | A1 * | 11/2007 | Fagrenius | B06B 1/16 340/407.1 |
| 2012/0207532 | A1 * | 8/2012 | Ho | A61N 5/0616 401/209 |

(Continued)

FOREIGN PATENT DOCUMENTS

| | | |
|---|---|---|
| CN | 201333835 | 10/2009 |
| CN | 107627737 | 3/2019 |

(Continued)

*Primary Examiner* — Anh T Vo
(74) *Attorney, Agent, or Firm* — Staas & Halsey LLP

(57) ABSTRACT

Example implementations relate to print substance container vibration. A vibrator for a print system may comprise a motor, and a vibration shaft coupled to the motor to cause vibration to provide redistribution of print substance of a print substance container. The vibration may be caused in response to the rotation of an eccentrically loaded weight about a central axis of the vibrator.

20 Claims, 3 Drawing Sheets

(56) References Cited

U.S. PATENT DOCUMENTS

| | | | | |
|---|---|---|---|---|
| 2014/0016431 | A1* | 1/2014 | Takenaka | B01F 29/30<br>366/108 |

FOREIGN PATENT DOCUMENTS

| | | | | |
|---|---|---|---|---|
| EP | 2218559 | | 8/2012 | |
| EP | 3263345 | | 1/2018 | |
| JP | 2008183838 | | 8/2008 | |
| JP | 2008273045 | | 11/2008 | |
| JP | 2011110511 | * | 6/2011 | B01D 29/11 |
| KR | 101042618 | | 6/2011 | |

* cited by examiner

PRINT SUBSTANCE CONTAINER VIBRATION

CROSS REFERENCE TO RELATED APPLICATIONS

This application is a U.S. National Stage Application which claims the benefit under 35 U.S.C. § 371 of International Patent Application No. PCT/US2018/026218 filed on Apr. 5, 2018, the contents of which are incorporated herein by reference.

BACKGROUND

Print substance containers or cartridges in printers provide print substance that is deposited onto paper during printing. Printers produce images by ejecting and or adhering print substance onto a print medium, such as a sheet of paper.

DETAILED DESCRIPTION

Figure 1:
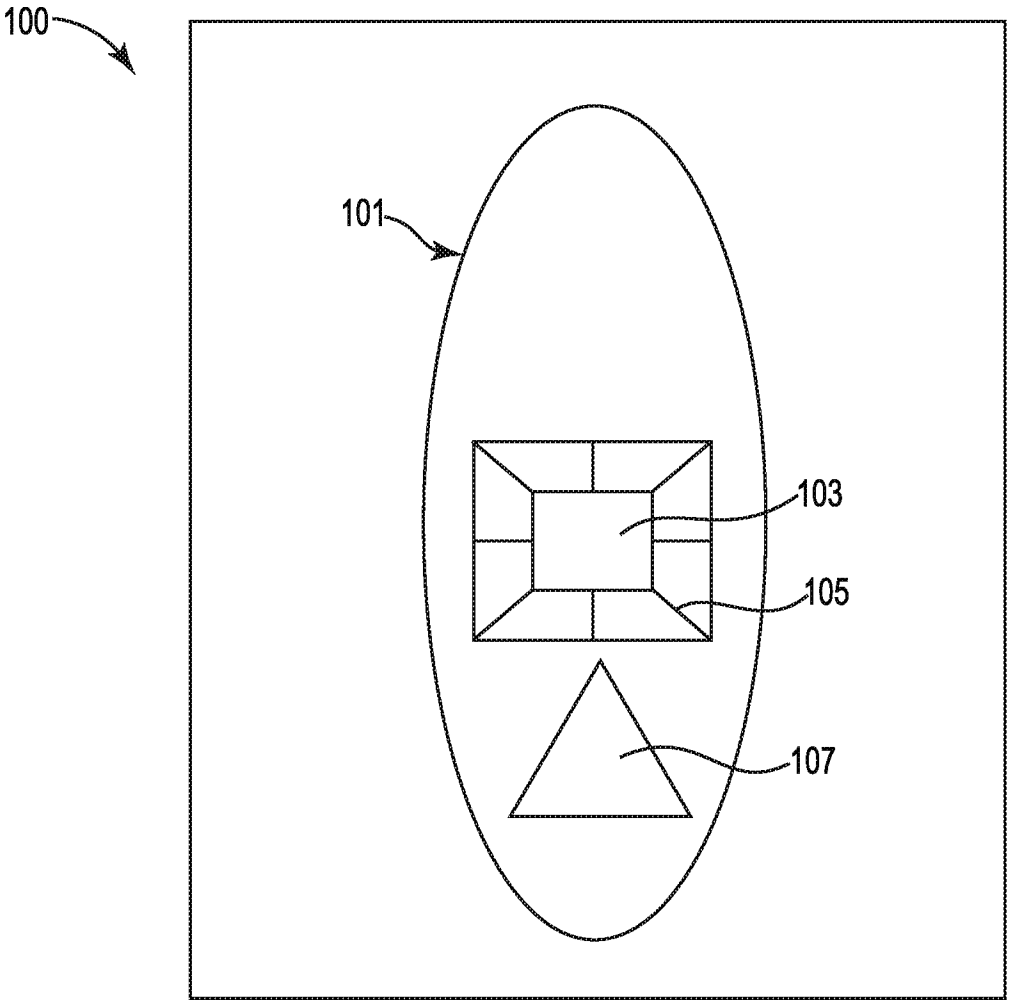
FIG. 1 illustrates an example of a vibrator of a print system according to the disclosure.

Print substance in a print substance container is utilized in the creation of images by a print system. As used herein, the term "print system", can for example, refer to a system that schedules, queues and spools printer output from an application to the printer. As used herein, the term, "print substance container", can, for example, refer to a component of a print system that print substance that is deposited onto paper during printing. As used herein, the term, "print substance", can, for example, refer to inks and/or toners. A print substance container recreates a digital image by depositing droplets of ink onto paper, plastic, or other substrates. A print substance container also produces images by an electrophotographic (EP) process to attach and adhere toner particles onto a print medium, such as a sheet of paper.

Print substance can become stranded in areas that are inaccessible by the normal agitation mechanisms. For example, print substance can dry in print substance container and cause the pigments and dyes to dry out and form a solid block of hardened mass that plugs the microscopic print substance passageways. Some print systems attempt to prevent this drying from occurring by covering the printhead nozzles with a rubber cap when the print system is not in use. However, abrupt power losses or unplugging the print system before it has capped the printhead can cause the printhead to be left in an uncapped state. Even when the head is capped, moisture and other solvent can seep out, causing the print substance to dry and harden. Once print substance begins to collect and harden, the drop volume can be affected, drop trajectory can change, or the print substance container can completely fail to jet print substance.

Print substance container vibration according to the disclosure can provide a steady flow of print substance by providing redistribution of print substance by activating vibrators. For instance, a user may determine that the print quality of a print system is running low based on the printed images (e.g., lighter images, broken images, etc.). In such an example, a vibrator according the present disclosure, coupled to the print system container, can be activated via an electromechanical switch to cause vibration. Vibration of the vibrator may redistribute print substance from inaccessible areas to development areas of the print substance container. As used herein, the term, "development areas", can, for example refer to an area of a print substance container where print substance can be accessed by standard agitation methods, and can be deposited onto the print medium.

In some examples, a print substance container may undergo physical intervention whereupon the print substance container is removed from the print system by a user, shaken, and reinstalled. This process can expose users to the print substance or endanger the print substance container to potential damage. Further, such intervention can cause for the print system to become contaminated.

Print substance container vibration according to the disclosure can provide steady flow of print substance by providing redistribution of print substance by activating a vibrator. For instance, a print system may estimate a print substance level in a print substance container via a microchip programmed in the print system to send a signal to a print system communication source. Based on the signal received, the print system communication source can activate the vibrator via an electromechanical switch to redistribute print substance.

A vibrator for a print system, according to the current disclosure, can include an eccentrically loaded weight. As used herein, an "eccentrically loaded weight", can, for example refer to a load acting on the vibrator that is offset from the centroid of the vibrator. An eccentrically loaded weight can establish the vibration of vibrator walls along the central axis of the vibrator.

FIG. 1 illustrates an example of a vibrator 101 of a print system 100 according to the disclosure. As illustrated in FIG. 1, vibrator 101 can include motor 103, vibration shaft 105, eccentrically loaded weight 107. Vibrator 101, as will be discussed further herein, can be activated to provide steady flow of print substance.

In some examples, motor 103 can be a compact engine. In one example, motor 103 is coupled with vibration shaft 105 and is located inside a print substance container included in print system 100 (not illustrated in FIG. 1). Print system 100 can include an electromechanical switch and a power supply source (not illustrated in FIG. 1). For example, print system 100 can activate motor 103 of vibrator 101 by activating the electromechanical switch using the power supply source.

In some examples, motor 103 can modify its electrical energy to mechanical energy and activate vibration shaft 105. For example, motor 103 can receive an activation signal from print system 100 and can activate vibration shaft 103 responsive to receipt of the activation signal.

As used herein, the term, "vibration shaft", can, for example, refer to a rotating and/or a vibrating propeller that absorbs power from an electrical source and transmits vibration from one part of a print system to another.

In some examples, vibrator 101 can have vibration shaft 105 coupled to motor 103. In one instance, vibration shaft, for example, can be made of composite materials such as polypropylene. In one example, vibration shaft, for example, can be made of metal.

Vibration shaft 105 may be arranged around the central axis of vibrator 101. While a single vibration shaft 105 is illustrated in FIG. 1, in some examples, vibrator 101 can include a plurality of vibration shafts.

In some examples, a power supply source of print system 100 can be manipulated by users based on users' desires. For example, a user may desire to turn on the power supply source and activate the electromechanical switch, turn off the power supply source and deactivate the electromechanical switch, or retrieve historical print data by turning on the power supply source.

In some examples, print system 100 can preprogram the print system communication source to activate the electromechanical switch based on a specific event, such as duration of print substance container vibration, print frequency, etc.

The print system communication source may be programmed by print system 100 to activate the electromechanical switch based on a duration of print substance container vibration and/or a frequency of print substance container vibration. As motor 101 is activated, the electrical energy of motor 101 is converted to mechanical energy for vibration shaft 105. The converted mechanical energy may activate vibration shaft 105 and cause vibration of vibrator 101. Vibration of vibrator 101 may redistribute print substance of a print substance container. For instance, vibration of vibrator 101 may cause redistribution of print substance of the print substance container in print system 100.

Vibrator 101 of print system 100, according to the current disclosure, can include eccentrically loaded weight 107. In some examples, motor 103 of vibrator 101 is attached to eccentrically loaded weight 107 about a central axis of the vibrator 101. As motor 103 is activated, it rotates eccentrically loaded weight 107. Eccentrically loaded weight 107 can establish the vibration of vibrator 101's walls.

In some examples, eccentrically loaded weight 107 may be at some distance from the centroid of vibrator 101 towards the right corners of vibrator 101. In some example, eccentrically loaded weight may be at some distance from the centroid of vibrator 101 towards the left corners of vibrator 101.

In some examples, eccentrically loaded weight 107 can rotate about the central axis of vibrator 101. The rotation of the eccentrically loaded weight 107 can cause vibration of vibrator 101.

In some examples, motor 103 may generate an electric pulse. For instance, an electric pulse generated by motor 103 may cause the eccentrically loaded weight 107 to be displaced and returned to the weight's original position. This act of displacement and return to the original position of eccentrically loaded weight may cause vibrator 101 to generate vibration.

In some examples, motor 103 and the vibration shaft 105 of vibrator 101 can be located inside a print substance container of print system 100.

In some examples, motor 103 and vibration shaft 105 of vibrator 101 can be located outside a print substance container of print system 100. For example, an externally coupled vibrator 101 may vibrate about an equilibrium point of the print substance container to release print substance from the inaccessible areas of the print substance container to a development area to use the print substance to print via the print system.

Figure 2:
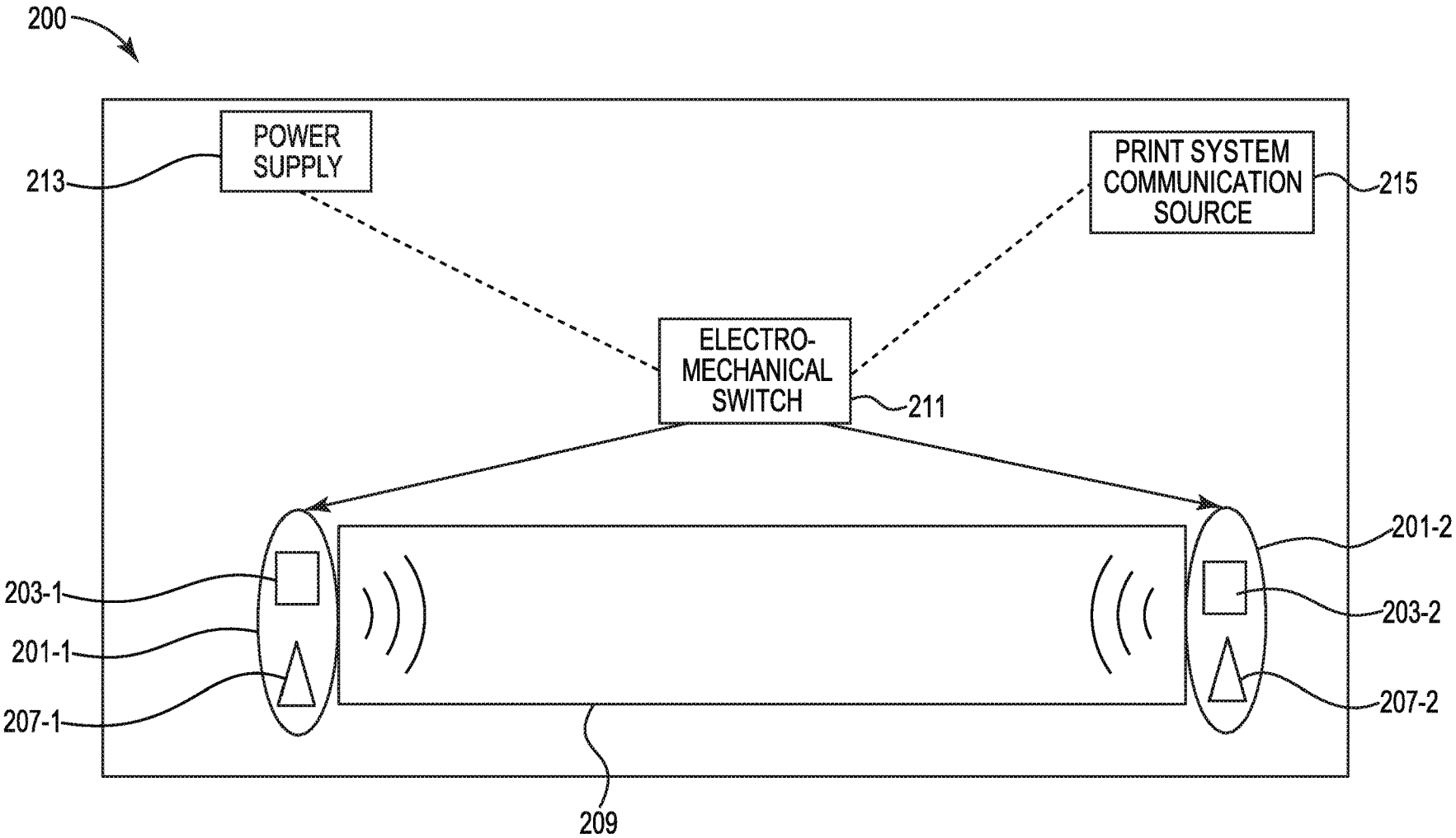
FIG. 2 illustrates an example of a print system to perform print substance container vibration according to the disclosure.

FIG. 2 illustrates an example of a print system 200 to perform print substance container vibration according to the disclosure. A print system 200 may be operated using a power supply source. The power supply source 213 can be programmed to activate an electromechanical switch 211 of the power system 200. Activation of the electromechanical switch 211 can activate vibrator 201. The motor 203 included in the vibrator 201 can convert electrical energy of the motor 203 to mechanical energy for the vibration shaft. The transformed energy can cause the vibrator 201 to vibrate using vibrations shafts Vibration of the vibrator 201 may redistribute print substance of a print substance container.

A print system 200 may be operated using a communication source 215 to activate the electromechanical switch 211 based on a specific event. Print system communication source 215 may be preprogrammed for an event (e.g., duration of print substance container vibration, print frequency, etc.) using the print system 200. Responsive to the preprogrammed event, electromechanical switch 211 of the print system 200 can be activated. Activation of the electromechanical switch 211 activates the motor 203 inside the vibrator 201. The motor 203 can convert electrical energy of the motor 203 to mechanical energy for the vibration shaft. The transformed energy can cause the vibrator 201 to vibrate. Vibration of the vibrator 201 may redistribute print substance of a print substance container 209.

In some examples, print system 200 may estimate a print substance level in a print substance container 209 via a microchip programmed in the print system to send a signal to a print system communication source 213. Based on the signal received, print system communication source 213 can activate the vibrator 201 via an electromechanical switch to redistribute print substance of print substance container 209.

In some examples, print system 200 may activate electromechanical switch 211 using a power supply source 213. Power supply source 213 of print system 200 can be manipulated by users based on users' necessity desires and/or requests.

Print system 200 can activate print substance container 209 by using vibrators 201-1, and 201-2 (referred to collectively as vibrator(s) 201). In some examples, print substance container 209 contains print substance that can be deposited onto paper during printing using print system 200.

In some examples, print system 200 can cause vibrators 201 to vibrate by activating electromechanical switch 211. For example, vibrator 201-1 having motor 203-1 and weight 207-1 can receiving vibration when electromechanical switch 211 is activated.

Motors 203-1 and 203-2 (referred to collectively as motor(s) 203) may be attached to weight 207-1 and 207-2 (referred to collectively herein as weight(s) 207) about a central axis of the vibrators 201. As motors 203 of vibrators 201 are activated via electromechanical switch 211, motors 203 rotate weight 207 by sending an electric pulse. The electric pulse forces weight 207 to displace and return to 207's initial position. The displacement of weight 207 can cause vibration to vibrators 201. For example, weight 207-1 can receive an electric pulse, displace, and return to its original place. This can create a vibration frequency about the central axis of vibrator 201-1. The vibration frequency of weight 207-1 can cause vibration to vibrator 201-1.

Vibration of vibrators 201-1 and 202-2 may redistribute print substance of a print substance container 209. When activated, vibrators 201 can provide steady flow of print substance by providing redistribution of print substance from the inaccessible areas of the print substance container to a development area to use the print substance to print via the print system.

As used herein, the term "inaccessible areas" of a print system container can, for example, refer to an area of the print substance container containing print substance that is difficult to access via routine agitation process of a print system. Vibration of vibrators 201 may redistribute print substance of a print substance container 209 from the substance from the inaccessible to a development area.

In some examples, print substance container 209 can be placed horizontally or longitudinally in print system 200. As used herein, the term "horizontally" can, for example, refer to placing the print substance container in a plane parallel to print system 200. As used herein, the term "longitudinally" can, for example, refer to placing the print substance container in a plane perpendicular to print system 200.

As noted, print system 200 can activate print substance container 209 by using vibrators 201. Vibrators 201 can be placed inside print substance container 209, or outside of print substance container 209, and/or combinations thereof. For example, vibrator 201-1 may be placed inside print substance container 209, and vibrator 201-2 may be placed outside print substance container 209. In some examples, both vibrators 201-1 and 202-2 may be placed inside print substance container 209.

In some examples, vibrator 201-1 and 201-2 may be placed outside a print substance container 209. Externally placed vibrators may vibrate about an equilibrium point of the print substance container to release print substance from the inaccessible areas of the print substance container to a development area.

In some instances, print system 200 may activate electromechanical switch 211 using a print system communication source 215. Print system 200 can preprogram print system communication source 215 to activate electromechanical switch 211 based on a specific event. For example, print system communication source 215 may be programmed by print system 200 to activate the electromechanical switch 211 based on duration of print substance container 209's vibration and/or based on a frequency of print substance container 209's vibration.

Print system communication source 215 can be programmed to collect, schedule, queue, and spool print substance container usage data from an application of print system 200. For example, print system communication source 215 source may be programmed to collect data based on print frequency. As print system 200 reaches a predetermined threshold for the printing frequency, the print system communication source 215 may activate electromechanical switch 211. For example, the print system communication source 215 may activate the electromechanical switch 211 based on a duration of print substance container 209 vibration.

In some examples, the print substance container 209 enters an inaccessible substance mode as the print substance in the print substance container 209 becomes hard to access via routine agitation process of a print system 200. In one example print substance container 209 enters an inaccessible substance mode when print substance volume reaches a lower than average threshold.

In some examples, toner quantity in a print substance container is tracked which translates to an approximate page remaining that can be printed. In one example, using this information, print system communication system 215 can signal electro-mechanical switch 211 to release the stranded toner. For example, print system communication system 215 can gauge print substance level to be a level to print approximately 500 pages remaining and signals to activate the vibrators for 10 seconds. In one example, the electromechanical switch 211 can programs vibrators to turn on every 100 pages until the cartridge has reached ~0 pages remaining.

For example, print system communication source 215 may collect data on print substance volume based on usage data of print substance container 209. Print system 200 may recognize that print substance volume has reached a lower than average threshold and authorize print substance container 209 to enter the inaccessible substance mode.

In some examples, the print substance container 209 enters the inaccessible substance mode responsive to a print substance container 209 being in use for a threshold time duration. For example, print system communication source 215 may collect data on print substance volume based on threshold time duration. Print system 200 may recognize that print substance volume has been in use for six months, for example, and authorize print substance container 209 to enter the inaccessible substance mode.

Print substance container 209 can receive print substance via a plurality of ink reservoirs from different locations within print system 200. In one example, print system 200 can have more than one ink reservoir, for example cyan ink reservoir, magenta ink reservoir, and yellow ink reservoir and black ink reservoir. In one example, print substance container 209 can receive print substance from one or reservoir(s) if print substance container 209 enters an inaccessible substance mode.

Figure 3:
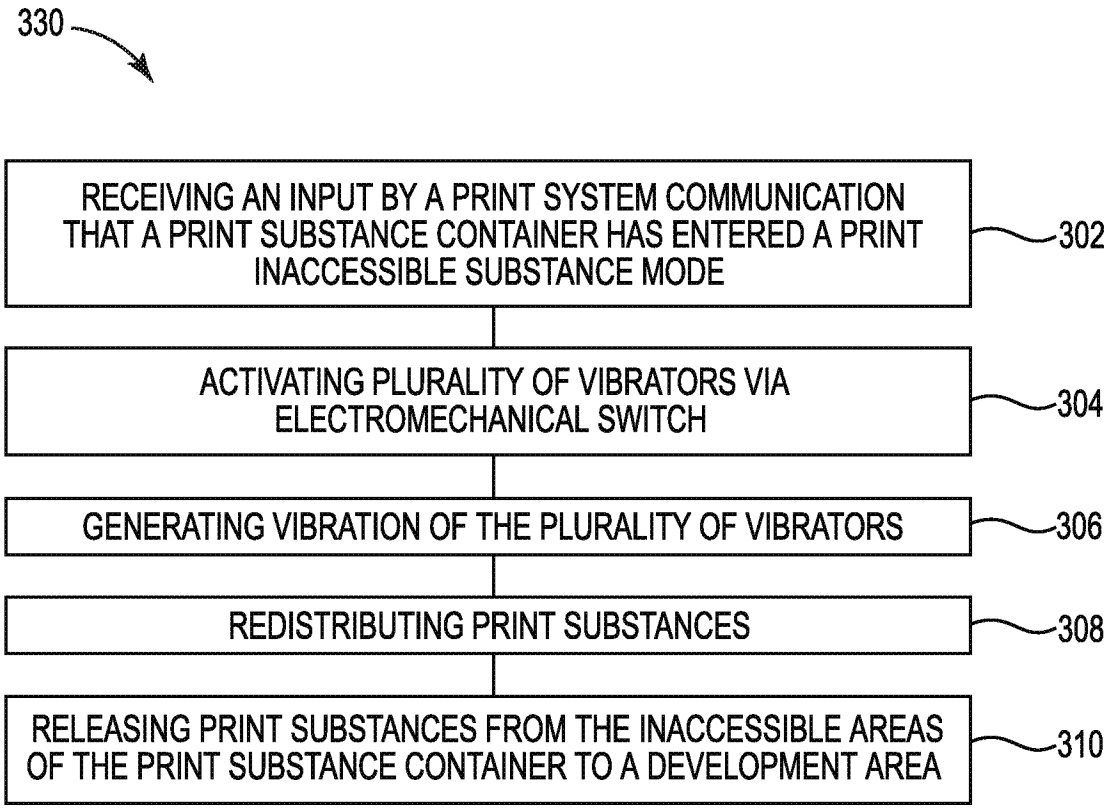
FIG. 3 illustrates an example method of print system using print substance container vibration according to the disclosure.

In some examples, print substance do not mix in the print substance container. For example, print substance in cyan reservoir, yellow reservoir and black reservoir remain contained in their respective reservoir and deposit into the paper independently FIG. 3 illustrates an example method 330 using print substance container vibration according to the disclosure. In some examples, method 330 can be performed by a print system such as print system 100 or 200 illustrated in FIGS. 1 and 2. In some examples, a print system may have a print system communication source, an electromechanical switch, and/or other hardware devices suitable for retrieval and execution of instructions to perform method 330.

At 302, method 330 includes receiving, by a print system communication source of a print system, an input that a print substance container of the print system has entered a mode indicating print substance is inaccessible, for instance an inaccessible substance mode. For example, a print system communication source can be preprogrammed to activate electromechanical switch based on a specific event such as reaching a threshold print substance container vibration and/or a threshold frequency of a print substance container vibration. The print system communication source 215, in some examples, may activate the electromechanical switch based on duration of print substance container vibration mode.

At 304, method 330 includes receiving, by a print system communication source of a print system, an input that an electromechanical switch is activated. The electromechanical switch activates the vibrators. For instance, a vibrator can be activated by activating a motor and vibration shafts coupled to the vibrator as illustrated in FIGS. 1 and 2.

At 306, method 330 includes receiving by a print system communication source of a print system, an input to cause vibration of the vibrators. For example, a motor located inside the vibrator may be attached to an eccentrically loaded weight about the central axis of the vibrator. As vibrator is activated via electromechanical switch, eccentrically loaded weight, coupled to the motor may rotate, causing vibration of the vibrator walls.

At 308, method 330 includes receiving, by a print system communication source of a print system, an input to redistribute print substance of the print substance container. Redistribution of print substance permits print substance from the inaccessible areas to be accessible. For example, vibrators may release print substance from an inaccessible area of the print substance container and provide steady flow of print substance.

At 310, method 330 includes receiving, by a print system communication source of a print system, an input to releases print substance from an inaccessible area of the print substance container to a development area. For instance, activated vibrators can provide steady flow of print substance by providing redistribution of print substance from the inaccessible areas of the print substance container to a development area to use the print substance to print via the print system.

The figures herein follow a numbering convention in which the first digit corresponds to the drawing figure number and the remaining digits identify an element or component in the drawing. Similar elements or components between different figures may be identified by the use of similar digits. For example, 102 may reference element "02" in FIG. 1, and a similar element may be referenced as 202 in FIG. 2. Elements shown in the various figures herein can be added, exchanged, and/or eliminated so as to provide a plurality of additional examples of the disclosure. In addition, the proportion and the relative scale of the elements provided in the figures are intended to illustrate the examples of the disclosure and should not be taken in a limiting sense. Further, as used herein, "a plurality of" an element and/or feature can refer to more than one of such elements and/or features.

What is claimed:

1. A vibrator for a print system comprising:

a motor activated by a print system communication source;

an eccentrically loaded weight; and a vibration shaft coupled to the motor to cause vibration to provide redistribution of print substance of a print substance container, wherein the vibration is caused in response to rotation of the eccentrically loaded weight about a central axis of the vibrator.

2. The vibrator of claim 1, wherein the motor is activated by an electromechanical switch in communication with the print system communication source.

3. The vibrator of claim 2, wherein the motor and the vibration shaft are placed inside the print substance container.

4. The vibrator of claim 2, wherein the motor and the vibration shaft are coupled outside the print substance container.

5. The vibrator of claim 2, further comprising a plurality of vibration shafts arranged around the central axis of the vibrator.

6. The vibrator of claim 2, wherein the motor and the vibration shafts are constructed from composite materials.

7. The vibrator of claim 1, wherein the motor is activated by the print system communication source in communication with an electromechanical switch.

8. The vibrator of claim 7, wherein the motor and the vibration shaft are placed inside the print substance container.

9. The vibrator of claim 1, wherein the motor and the vibration shaft are placed inside the print substance container.

10. The vibrator of claim 1, wherein the motor and the vibration shaft are coupled outside the print substance container.

11. The vibrator of claim 1, further comprising a plurality of vibration shafts arranged around the central axis of the vibrator.

12. The vibrator of claim 1, wherein the motor and the vibration shafts are constructed from composite materials.

13. A method comprising:

receiving, by a print system communication source of a print system, an input that a print substance container of the print system has entered a mode indicating print substance is inaccessible;

activating a plurality of vibrators, coupled to the print substance container by activating an electromechanical switch, wherein the activation is based on a programmable frequency, a duration of vibration, and combinations thereof;

generating vibration of the plurality of vibrators;

redistributing print substance of the print substance container in response to the vibration of the plurality of vibrators; and releasing print substance from the inaccessible areas of the print substance container to a development area to use the print substance to print via the print system.

14. The method of claim 13, further comprising the plurality of vibrators causing vibrations by rotating an eccentrically loaded weight about a central axis of the plurality of vibrators.

15. The method of claim 13, further comprising activating the electromechanical switch by activating a power supply source of the print system.

16. A print system comprising:

a print substance container;

a plurality of vibrators coupled to the print substance container to:

determine the print substance container has entered an inaccessible substance mode;

activate the plurality of vibrators by activating an electromechanical switch causing vibration by an electric pulse to force a weight to displace and return to the weight's initial position;

redistribute print substance of the print substance container; and release print substance in the inaccessible areas of the print substance container to print via the print system.

17. The print system of claim 16, wherein the print substance container enters the inaccessible substance mode as print substance volume reaches a lower than average threshold.

18. The print system of claim 16, wherein the print substance container enters the inaccessible responsive mode as the print substance container is in use for a threshold time duration.

19. The print system of claim 16, wherein the print substance container receives print substance via a plurality of ink reservoirs from different locations within the print system.

20. The print system of claim 16, wherein the electromechanical switch is activated by a print system communication source, wherein the activation is based on a programmable frequency, a duration of vibration, and combinations thereof.

* * * * *